US006379128B1

(12) United States Patent
Dietrich

(10) Patent No.: US 6,379,128 B1
(45) Date of Patent: Apr. 30, 2002

(54) END BELL COVER FOR WATER PUMP MOTOR

(76) Inventor: Dan Dietrich, 238 S.E. 7th Ave., Delray Beach, FL (US) 33483

( * ) Notice: Subject to any disclaimer, the term of this patent is extended or adjusted under 35 U.S.C. 154(b) by 0 days.

(21) Appl. No.: 09/710,108

(22) Filed: Nov. 10, 2000

Related U.S. Application Data

(60) Provisional application No. 60/164,468, filed on Nov. 10, 1999.

(51) Int. Cl.[7] ..... F09B 35/04
(52) U.S. Cl. ..... 417/423.11
(58) Field of Search ..... 417/423.11; 92/86

(56) References Cited

U.S. PATENT DOCUMENTS 570,726 A * 11/1896 Butts ..... 92/86
5,338,153 A * 8/1994 Swanson et al. ..... 415/168.2
5,499,902 A * 3/1996 Rockwood et al. ..... 415/113

* cited by examiner

*Primary Examiner*—Charles G. Freay
(74) *Attorney, Agent, or Firm*—Robert M. Downey, P.A.

(57) ABSTRACT

A cover sized and configured for mating attachment to the end bell of a motor housing, between the end bell and the seal plate of a water pump housing, is structured and disposed to catch and drain water exteriorly of the motor housing, thereby preventing water from entering the motor housing and damaging components therein. The cover includes a front face having a concave portion defining a dish, a convex rear face, a peripheral flange surrounding the dish, and a downwardly depending lip for draining water from the dish. A central zone of the dish includes a raised annular hub with a centrally disposed aperture for passage of the motor's shaft therethrough.

14 Claims, 4 Drawing Sheets

END BELL COVER FOR WATER PUMP MOTOR

This application claims benefit of Prov. No. 60/164,468 filed Nov. 10, 1999.

BACKGROUND OF THE INVENTION

1. Field of the Invention

The present invention relates to covers for attachment to water pump motors and, more specifically, to an end bell cover structured and disposed to catch and drain water from the end bell of a motor, thereby preventing water damage to the internal components of the motor.

2. Discussion of the Related Art

Water pump motors, such as motors used to operate pool pumps, include end bells at the opposite ends of the motor housing for holding the bearings and other internal components within the motor housing. A drive shaft extends from the front end bell and into the water pump housing for rotating the pump impeller therein. Seals fitted to the shaft, at the entry in the seal plate of the water pump housing, prevent water from leaking from the pump.

Eventually, the seals on the shaft of the motor become damaged or worn, causing water to leak from the water pump and along the shaft. As the shaft spins, the water is dispersed about the front end bell by a slinger which is fitted to the shaft. Eventually, the water enters through the front end bell and into the internal chamber of the motor housing, causing damage to the components therein.

In view of the above-described problems associated with motor driven water pumps, and particularly pool pumps, there is an urgent need for a simple and inexpensive cover device which is structured for attachment to the end bell of a motor and which is adapted to prevent entry of water into the internal chamber of the motor housing.

SUMMARY OF THE INVENTION

The present invention is directed to a cover formed of a relatively thin sheet of plastic or other flexible, durable material. The cover is sized and configured for mating attachment to the end bell of a motor housing, between the end bell and the seal plate of a water pump housing. A dish is structured and disposed to catch and drain water exteriorly of the motor housing, thereby preventing water from entering the motor housing and damaging components therein. The cover includes a front face having a concave portion defining the dish, a convex rear face, a peripheral flange surrounding the dish, and a downwardly depending lip for draining water from the dish. A central zone of the dish includes a raised annular hub with a centrally disposed aperture for passage of the motor's shaft therethrough.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
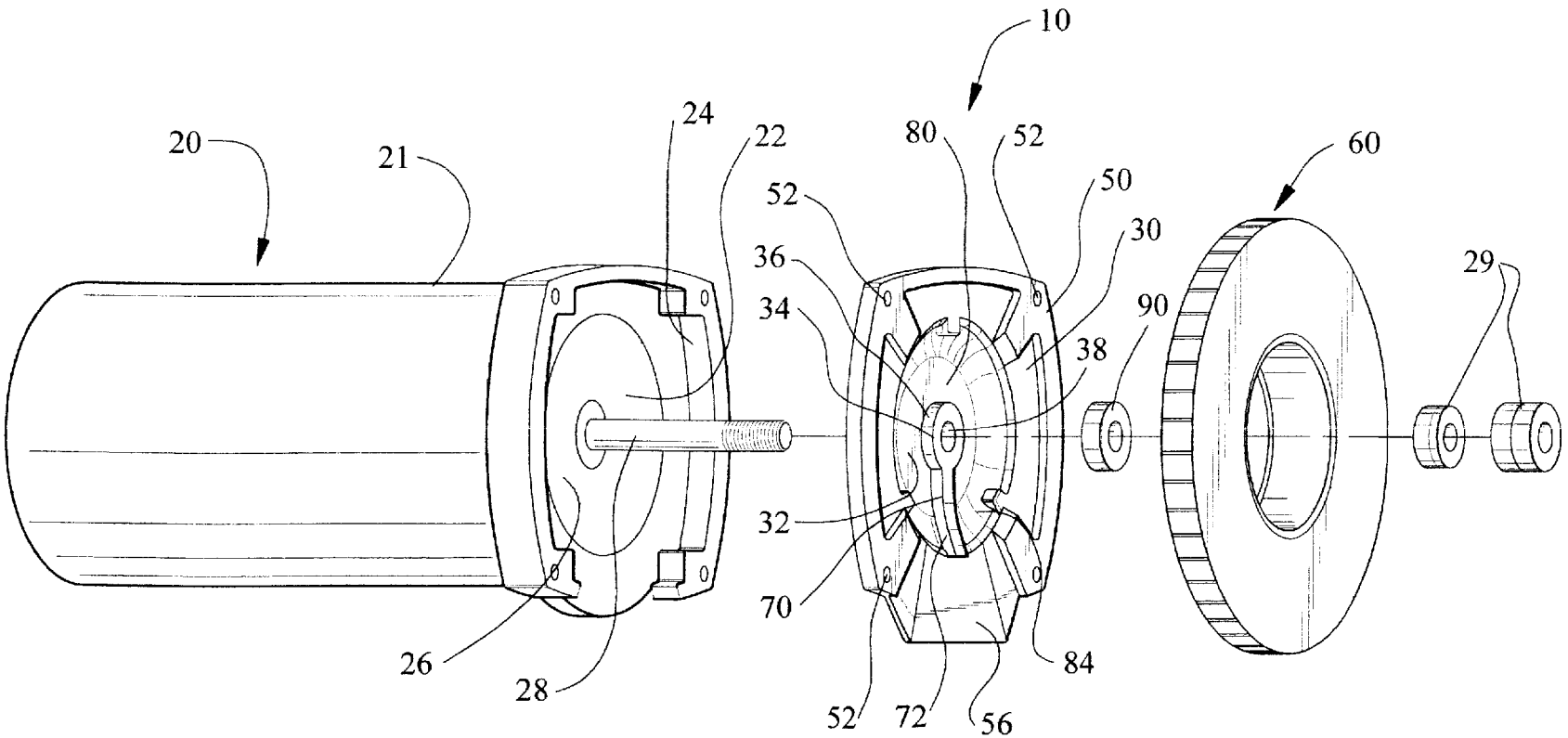
FIG. 1 is an exploded perspective view showing the assembly of the cover of the present invention between an end bell of a motor and the seal plate of water pump.
Figure 2:
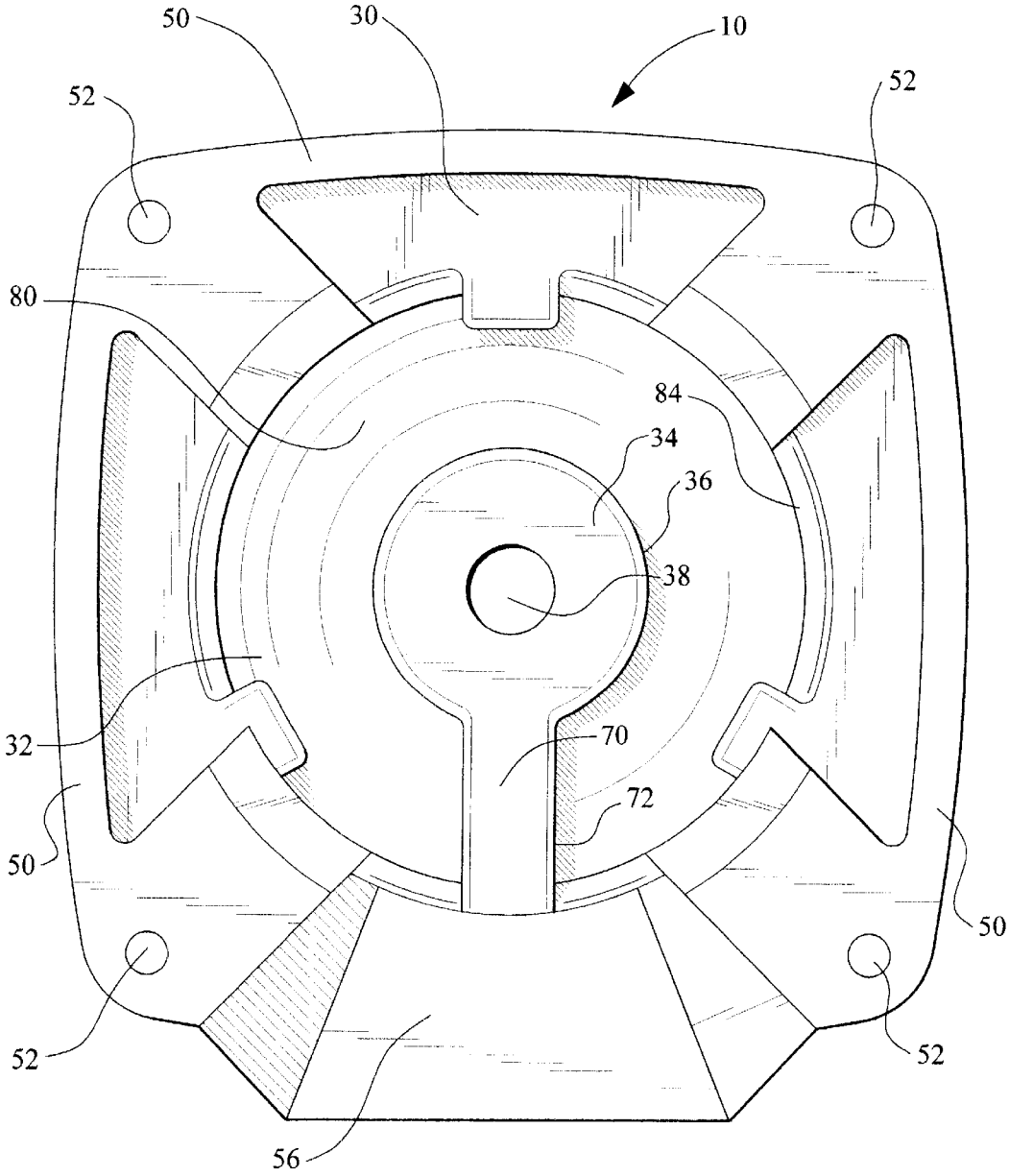
FIG. 2 is a front elevational view of the end bell cover of the present invention.
Figure 3:
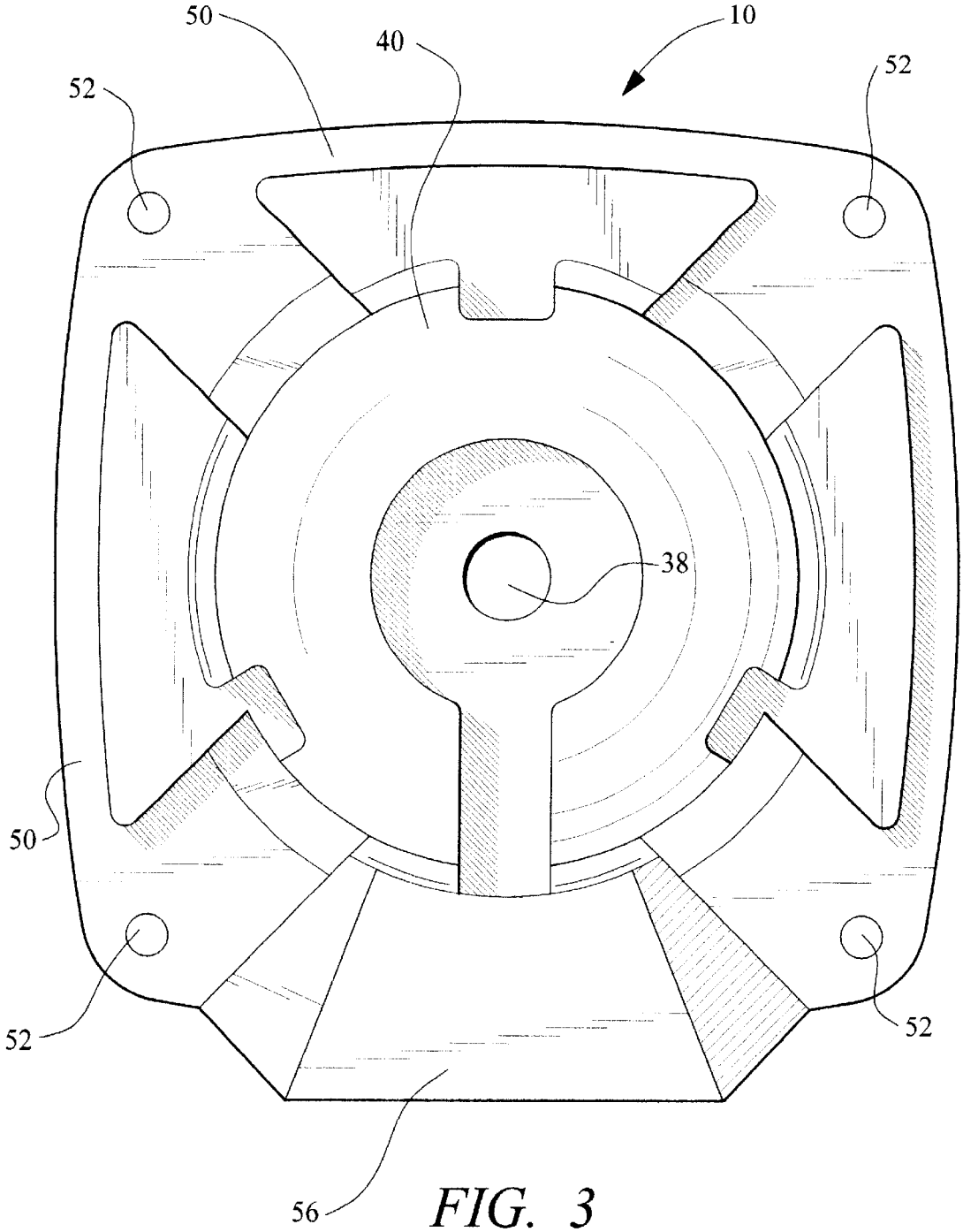
FIG. 3 is a rear elevational view of the end bell cover of the present invention.

Referring to the several views of the drawings, and initially to FIG. 1, the end bell cover of the present invention is shown and generally indicated as 10. The end bell cover 10 is specifically structured and configured for attachment to the end bell 22 of a motor 20. The end bell cover 10 includes a front face 30, a rear face 40, and a peripheral flange 50. The peripheral flange 50 is sized and configured for mating receipt with the flange 24 of the end bell of the motor housing 21 and includes correspondingly aligned apertures 52 for passage of mounting lugs therethrough for securing the motor and end bell cover 10 to a seal plate 60 of a water pump.

Figure 4:
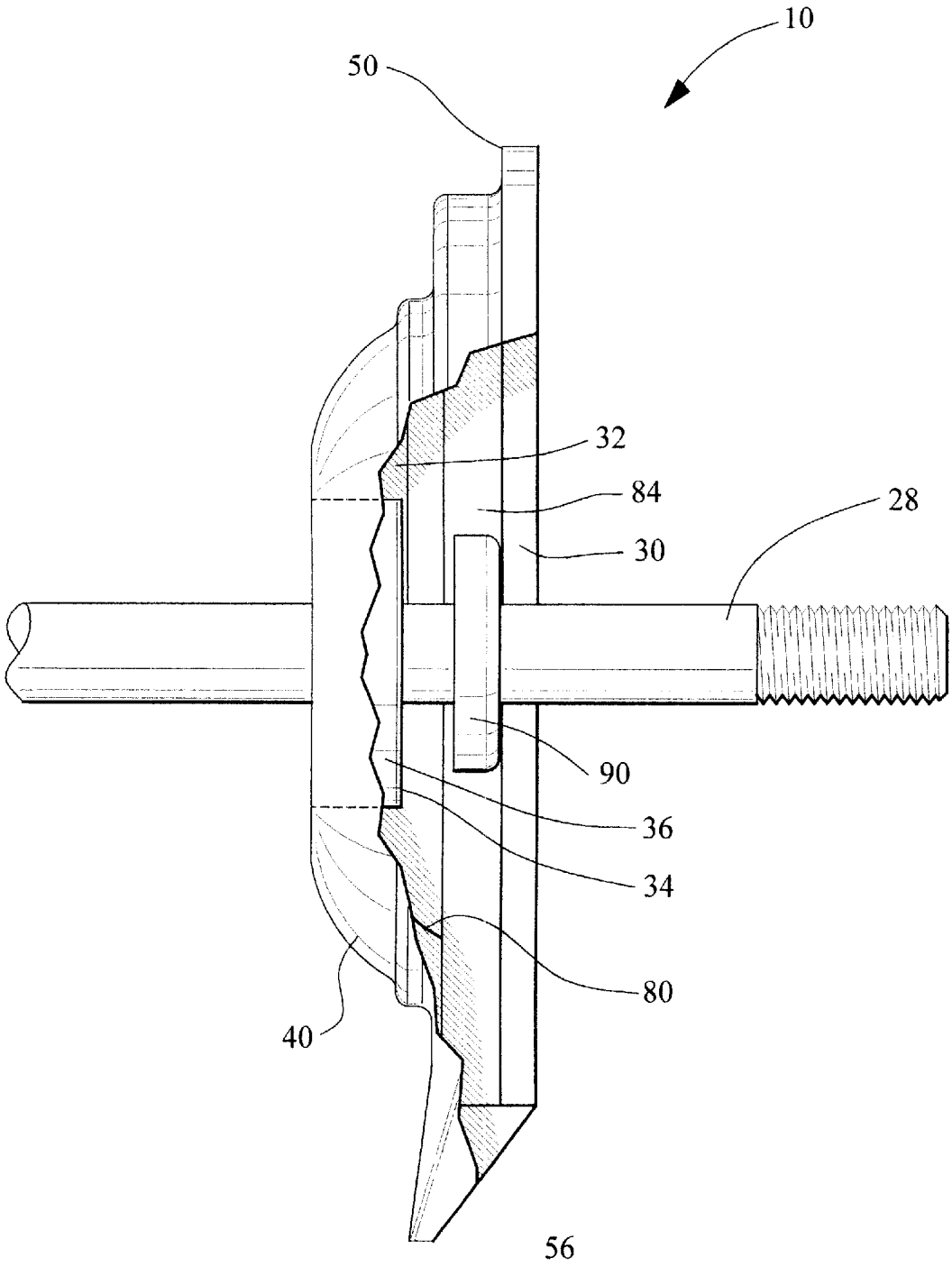
FIG. 4 is a side elevation, in partial cutaway, showing the end bell cover of the present invention fitted about the shaft of a motor, within the end bell of the motor.

The end bell cover 10 further includes a dish portion 32 which is concave on the front face 30 and generally convex on the rear face 40. The dish portion 32 is surrounded at least partially by the peripheral flange 50 and is disposed in fluid communication with a downwardly depending lip 56. The dish portion 32 is sized and configured for receipt within the concave area 26 of the end bell 22 on the motor housing 21. A central zone of the dish 32 includes a raised hub 34 on the front face. The raised hub includes an annular shoulder 36 adjacent the base of the dish portion and a centrally disposed hole 38 for passage of the motor's shaft 28 therethrough. In one preferred embodiment, a raised rib 70 extends downwardly from the hub 34 to the lip 56. An inner surface of the dish, on the front face, includes a dish base 80, and an annular wall 84 surrounding the dish base. Once the end bell cover 10 is fitted to the end bell 22 of the motor 20, with the shaft 28 extending through the central hole 38 of the hub, a slinger 90 is fitted about the shaft 28 and within the confines of the dish portion 32 so that the annular wall 84 of the dish portion is generally co-planar with the slinger 90, as best seen in FIG. 4.

When the seals 29 on the shaft 28, adjacent the seal plate of the water pump, become worn or damaged, water travels along the shaft 28 towards the end bell of the motor. Upon reaching the slinger 90, the water is dispersed radially outward against the annular wall 84 of the dish. Droplets of water then travel downwardly, around the annular wall 84 and dish base 80 towards the lip 56. The annular shoulder 36 of the hub 34 further directs water from the dish base, downwardly to the lip, discouraging the water from reaching the shaft, behind the slinger 90. In the embodiment wherein the rib 70 is provided, water is further directed from the annular shoulder 36 of the hub 34, downwardly along the sides 72 of the rib 70 and to the lip. Thus, the rib serves the function of directing water flow from the hub to the lip. The water then drips from the lip portion to the ground, exterior of the motor housing.

In a preferred embodiment, the end bell cover is formed of a durable, yet flexible material which is capable of withstanding heat generated by the motor. Preferably, the end bell cover is formed of a styrene composition, such as ABS plastic. Alternatively, the end bell cover may be formed of polyvinyl chloride (PVC) or other suitable plastic material. The end bell cover may be manufactured using conventional and well known molding techniques including vacuum form molding and/or injection molding.

While the instant invention has been shown and described in accordance with a preferred and practical embodiment thereof, it is recognized that departures from the instant disclosure are contemplated within the spirit of the invention and, therefore, the scope of patent protection is not intended to be limited except as defined within the following claims as interpreted under the doctrine of equivalents.

What is claimed is:

1. A cover device for an end bell of a motor housing of a motor used for operating a water pump, wherein the motor includes a shaft extending outwardly from the end bell for driven engagement with the water pump, said cover device comprising:

an integral body sized and configured to overly the end bell of the motor housing, in covering relation thereto, and comprising:

a front face including a concave portion defining a dish;

a convex rear face;

a peripheral flange surrounding said dish, said peripheral flange being sized and configured to mate with a surface of the motor housing surrounding the end bell;

a downwardly depending lip disposed in fluid communication with said dish;

a central zone within said dish, said central zone including a raised annular hub with a centrally disposed aperture formed through said annular hub for passage of the shaft of the motor therethrough;

said dish being structured and disposed for capturing water released from the shaft of the motor during rotation thereof; and said downwardly depending lip being structured and disposed for directing the captured water from said dish to an exterior of the motor housing.

2. The cover device as recited in claim 1 wherein said dish includes a dish base and an annular wall surrounding said dish base, said annular wall being structured and disposed for capturing the water released from the shaft of the motor during rotation of the shaft, and said dish base being structured and disposed to direct the captured water towards said downwardly depending lip.

3. The cover device as recited in claim 2 further comprising a raised rib on said front face, said raised rib extending downwardly from said raised annular hub to said downwardly depending lip and said raised rib being structured and disposed to direct the captured water to said downwardly depending lip.

4. The cover device as recited in claim 3 wherein said peripheral flange includes a plurality of apertures formed therethrough, said plurality of apertures being sized and positioned for corresponding alignment with mounting lugs extending between said motor housing and said water pump.

5. The cover device as recited in claim 4 wherein said integral body is formed from a plastic sheet material.

6. The cover device as recited in claim 5 wherein said plastic sheet material comprises a styrene composition.

7. The cover device as recited in claim 5 wherein said plastic sheet material is polyvinyl chloride.

8. A cover device for an end bell of a motor housing of a motor used for operating a water pump, wherein the motor includes a shaft extending outwardly from the end bell for driven engagement with the water pump, said cover device comprising:

an integral body sized and configured to overlie the end bell of the motor housing, in covering relation thereto, and comprising:

a front face having a concave portion defining a dish;

a convex rear face;

a peripheral flange sized and configured to mate with a surface of the motor housing surrounding the end bell;

a central zone within said dish, said central zone including a raised annular hub with a centrally disposed aperture formed through said annular hub for passage of the shaft of the motor therethrough;

said dish defined by said concave portion being structured and disposed for capturing water released from the shaft of the motor during rotation of the shaft; and means for directing the captured water to an exterior of the motor housing and including a downwardly depending lip extending from said dish.

9. The cover device as recited in claim 8 wherein said dish includes a dish base and an annular wall surrounding said dish base, said annular wall being structured and disposed for capturing the water released from the shaft of the motor during rotation of the shaft, and said dish base being structured and disposed to direct the captured water towards said downwardly depending lip.

10. The cover device as recited in claim 9 further comprising a raised rib on said front face, said raised rib extending downwardly from said raised annular hub to said downwardly depending lip and said raised rib being structured and disposed to direct the captured water to said downwardly depending lip.

11. The cover device as recited in claim 10 wherein said peripheral flange includes a plurality of apertures formed therethrough, said plurality of apertures being sized and positioned for corresponding alignment with mounting lugs extending between said motor housing and said water pump.

12. The cover device as recited in claim 11 wherein said integral body is formed from a plastic sheet material.

13. The cover device as recited in claim 12 wherein said plastic sheet material comprises a styrene composition.

14. The cover device as recited in claim 12 wherein said plastic sheet material is polyvinyl chloride.

* * * * *